US009003953B2

(12) United States Patent
Brennan, III

(10) Patent No.: US 9,003,953 B2
(45) Date of Patent: Apr. 14, 2015

(54) LOCKABLE HYDRAULIC ACTUATOR

(75) Inventor: William E. Brennan, III, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 752 days.

(21) Appl. No.: 13/232,727

(22) Filed: Sep. 14, 2011

(65) Prior Publication Data

US 2013/0061742 A1 Mar. 14, 2013

(51) Int. Cl.
*F15B 15/26* (2006.01)
*E21B 17/10* (2006.01)

(52) U.S. Cl.
CPC ..... *E21B 17/1014* (2013.01); *F15B 15/261* (2013.01)

(58) Field of Classification Search
CPC .. F15B 2015/26; F15B 2211/72; F15B 15/26; F15B 15/261; F15B 15/262; F15B 15/265
USPC ..... 92/18, 19, 24, 27
See application file for complete search history.

(56) References Cited

U.S. PATENT DOCUMENTS

| | | | | | |
|---|---|---|---|---|---|
| 2,811,951 | A * | 11/1957 | Bodem et al. | ..... | 92/14 |
| 3,342,111 | A * | 9/1967 | Royster | ..... | 92/24 |
| 3,353,455 | A * | 11/1967 | Berry | ..... | 92/24 |
| 3,580,140 | A * | 5/1971 | Walker | ..... | 92/25 |
| 3,736,844 | A * | 6/1973 | Jahnke | ..... | 92/24 |
| 5,025,708 | A * | 6/1991 | Smith et al. | ..... | 92/19 |
| 5,205,203 | A * | 4/1993 | Rossato | ..... | 92/19 |
| 6,283,011 | B1 * | 9/2001 | Assumel-Lurdin | ..... | 92/134 |
| 2013/0062075 | A1 | 3/2013 | Brennan | | |

FOREIGN PATENT DOCUMENTS

| | | | | |
|---|---|---|---|---|
| DE | 19749176 | A1 * | 5/1999 | ..... F15B 15/26 |
| RU | 2042796 | C1 | 8/1995 | |
| RU | 2125642 | C1 | 1/1999 | |
| RU | 2305299 | C2 | 8/2007 | |
| SU | 1511138 | A1 | 9/1989 | |
| WO | 2005071441 | A1 | 8/2005 | |

OTHER PUBLICATIONS

International Search Report & Written Opinion issued in PCT/US2012/055108 on Dec. 27, 2012; 6 pages.

* cited by examiner

*Primary Examiner* — Dwayne J White
*Assistant Examiner* — Matthew Wiblin
(74) *Attorney, Agent, or Firm* — Cathy Hewitt

(57) ABSTRACT

An apparatus comprising a downhole tool having a body defining an outer surface, a plurality of standoffs distributed about the outer surface, and a hydraulic circuit operatively coupled to the standoffs. The hydraulic circuit includes a plurality of hydraulically actuated pistons, each of which is operatively coupled to a respective one of the standoffs to extend and retract the respective standoff. The pistons are hydraulically coupled and sized to extend or retract the respective standoffs at substantially the same rate in response to a hydraulic control signal.

8 Claims, 9 Drawing Sheets

LOCKABLE HYDRAULIC ACTUATOR

CROSS-REFERENCE TO RELATED APPLICATIONS

This application is related to U.S. patent application Ser. No. 13/232,656, entitled "Hydraulically Actuated Standoff," filed concurrently herewith.

BACKGROUND OF THE DISCLOSURE

Operating a logging tool in an open (i.e., uncased) borehole can present certain difficulties. For example, if the tool penetrates the mudcake lining the wall of the borehole and exposes the underlying formation, the tool can become differentially stuck against the borehole wall. When the relatively lower pressure formation is exposed to the relatively higher pressure drilling fluid in the borehole, the drilling fluid begins to flow into the formation. If the body of the tool is adjacent the exposed formation, the tool can be drawn against the exposed part of the formation and held against the formation with several thousand pounds of force. In some cases, the amount of force holding the tool against the borehole wall may be sufficiently high to prevent removal of the tool without damage to the tool.

Standoffs and/or centralizers have been used to prevent downhole tools from becoming differentially stuck against a borehole wall. Some known standoffs are implemented as flexible strap-on devices, metal rings, fins and/or irregular portions of a tool body. Some known centralizers may be fin-shaped and/or may include extendable/retractable portions to adjust the centralizer for operation in different diameter boreholes. While the foregoing known devices may be used to help prevent downhole tools from becoming differentially stuck in a borehole, these known devices also tend to increase the envelope (e.g., the outer diameter) of the tool body and, thus, increase the risk of the tool becoming stuck in a given size borehole.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
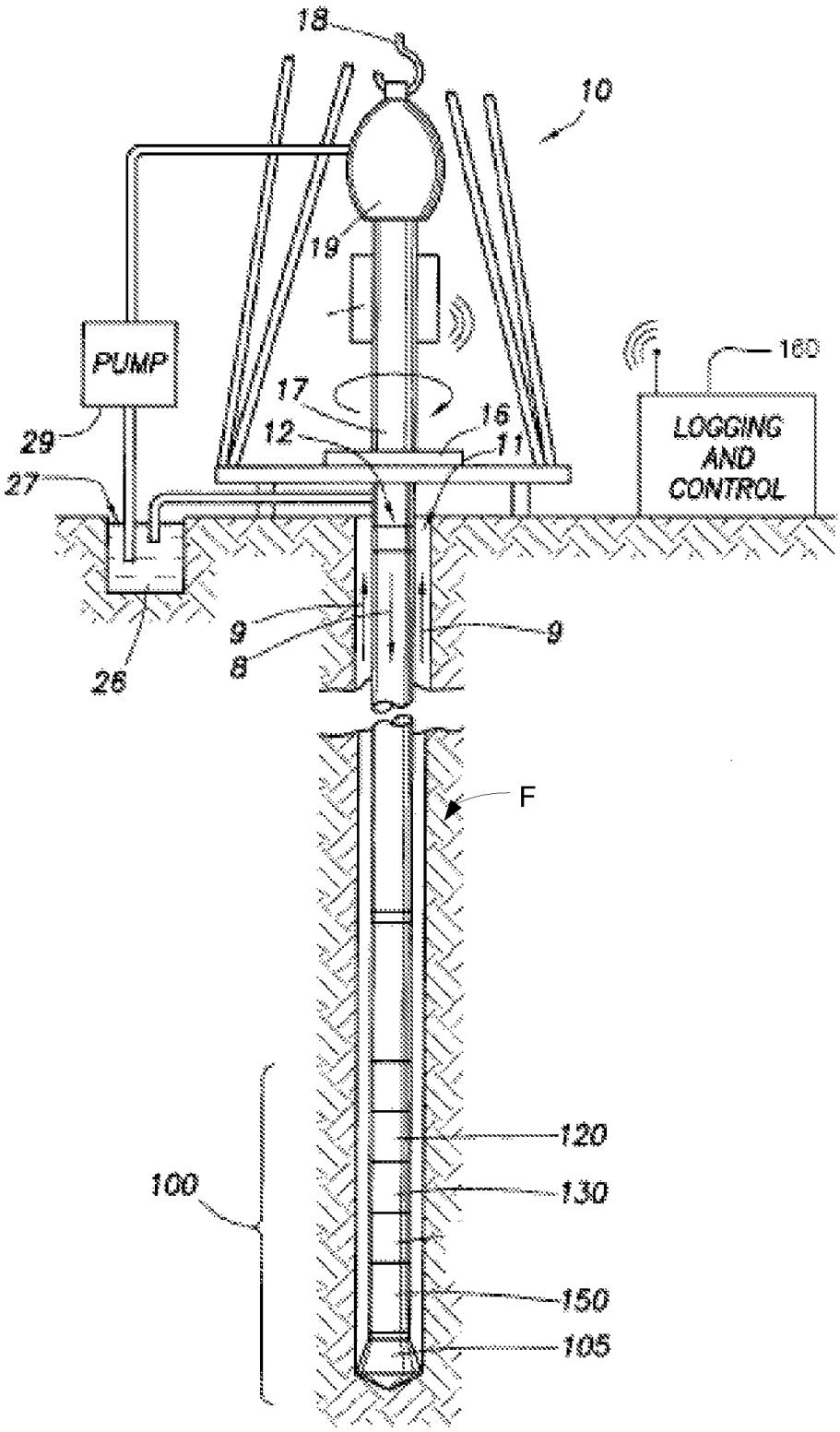
FIG. 1 is a wellsite system according to one or more aspects of the present disclosure.

It is to be understood that the following disclosure provides many different embodiments or examples for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

One or more aspects of the present disclosure relate to hydraulically actuated standoffs for downhole tools. In one aspect, the hydraulically actuated standoffs described herein are configured to deploy (e.g., extend) from and retract toward an outer surface of a body of a downhole tool at substantially the same rate and amount in response to a hydraulic control signal. Such a substantially uniform deployment or extension of the standoffs may facilitate or ensure that a downhole tool is properly centralized within a borehole (e.g., an open borehole) and, thus, may be used to prevent the downhole tool from becoming differentially stuck within the borehole. Alternatively or additionally, in the event that a downhole tool becomes stuck against a borehole wall (e.g., differentially stuck), the standoffs described herein may be used to push the downhole tool away from the borehole wall and, thus, unstick or free the tool. Still further, in accordance with the examples described herein, the number of standoffs and/or the geometry and dimensions of the standoffs may be particularly selected or optimized for use in particular diameter boreholes.

To ensure the uniform deployment or extension of the standoffs described herein, the examples described herein may include a hydraulic circuit having a plurality of serially hydraulically coupled proportionally sized pistons. More specifically, a hydraulic control signal may be applied to a front side or first surface of one of the pistons and the back side or other, opposing surface of that piston may be hydraulically coupled to the front side or first surface of a second one of the pistons, the back side of which may be further hydraulically coupled to yet another front side of a third piston. Of course, more than or fewer than three pistons may be serially hydraulically coupled in this manner.

Each side or face of each piston has an effective surface area against which a pressurized hydraulic fluid generates a force to urge the piston to move along a bore in which the piston slides. However, in the examples described herein, the back side of each piston is coupled to a stem which, in turn, is coupled to a respective standoff to move the standoff as the piston moves. As a result, the back side of the piston to which the stem is coupled has a smaller effective surface area than the opposing or front side of the piston. Thus, to ensure the uniform deployment of pistons that are serially hydraulically coupled as noted above, in the examples described herein, the front side of any piston hydraulically coupled to a back side of a preceding piston is made to have substantially the same effective surface area as the back side of the preceding piston. In this manner, in a hydraulic circuit having a plurality of serially hydraulically coupled pistons, the front sides of the pistons are proportionally sized to match the back sides (i.e., the stem sides) of any preceding pistons.

In operation, a single hydraulic control signal may be applied to the front side of a first (i.e., the largest) piston to cause all of the serially coupled pistons to move and, thus, extend the standoffs at substantially the rate and substantially the same amount. To retract the standoffs, a hydraulic signal may be applied to the back side of the last (i.e., the smallest) piston, thereby retracting all of the pistons at substantially the same rate.

In one example described herein, a downhole tool having a body defining an outer surface may include a plurality of standoffs distributed about the outer surface. A hydraulic circuit may be operatively coupled to the standoffs, where the hydraulic circuit includes a plurality of hydraulically actuated pistons, each of which may be operatively coupled to a respective one of the standoffs to extend and retract the respective standoff. In accordance with the teachings of this disclosure, the pistons are hydraulically coupled (e.g., hydraulically serially coupled) and sized to extend or retract the respective standoffs at substantially the same rate in response to a hydraulic control signal.

In this example, each of the pistons may be configured to slide within a bore and to define first and second opposing chambers within the bore, and each of the first chambers includes a respective first fluid port and each of the second chambers includes a respective second fluid port. To hydraulically couple the pistons, the hydraulic control signal is coupled to the first fluid port of the first chamber defined by a first one of the pistons and the second fluid port of the second chamber defined by the first one of the pistons is fluidly coupled to the first fluid port of the first chamber defined by a second one of the pistons. Similarly, the second fluid port of the second chamber defined by the second piston is fluidly coupled to the first fluid port of the first chamber defined by a third one of the pistons. As noted above, to ensure the uniform deployment or extension of the standoffs, the effective surface area of the front side of the second piston is substantially equal to the effective surface area of the back side of the first (i.e., the largest) piston and the effective surface area of the front side of the third (i.e., the smallest) piston is substantially equal to the effective surface area of the back side of the second piston.

A set line may be coupled to the first fluid port of the first chamber (i.e., the front side) defined by the first piston, and the second chamber (i.e., the back side) defined by the third piston may be fluidly coupled to a retract line. When the hydraulic control signal is applied to the set line, the pistons may uniformly displace and extend the standoffs away from the body of the tool. The extension of the standoffs may be performed, for example, in response to a command to centralize the tool or to unstick the tool from a borehole wall. Further, the hydraulic control signal applied to the set line may be provided by a flowline piston or other pump which may be located in another tool separate from the tool containing the standoffs and pistons.

Conversely, when the hydraulic signal is applied to the retract line, the pistons may retract toward the body of the tool. The hydraulic control signal applied to the retract line may be fluidly coupled to an oil reservoir. Additionally, the example hydraulic circuit may include a plurality of valves (e.g., check valves, relief valves, etc.), where each of the valves fluidly couples across the fluid ports associated with a respective one of the pistons to enable or facilitate the removal of fluid from the first chambers (i.e., the chambers defined by the front sides of the pistons) to ensure that the standoffs are substantially fully retracted. When fully retracted, the standoffs may lie within an outer envelope of the body of the tool.

In another example described herein, the pistons may be integrated within a stepped piston such that movement of the stepped piston produces a plurality of hydraulic signals having substantially equal hydraulic fluid flow rates and pressures. More specifically, each step (i.e., piston surface) of the stepped piston may define a piston having a surface such that all of the piston surfaces have substantially equal effective areas. As a result, movement of the stepped piston within its bore causes each of the substantially equal piston surfaces to move the same amount of hydraulic fluid. The hydraulic fluid moved by each of the substantially equal piston surfaces may be coupled via separate hydraulic lines or paths to respective standoff pistons, where each of the standoff pistons may be identical or at least substantially similar. Thus, the movement of the stepped piston causes the standoff pistons and, accordingly, the standoffs coupled thereto, to move (e.g., extend or retract) at substantially the same rate and substantially the same amount.

The examples described herein may further include apparatus to lock one or more of the pistons in an extended position. For example, without a mechanical locking device, even relatively small hydraulic leaks may cause one or more of the standoffs to retract, particularly over relatively long periods of time during which the standoffs are held in an extended position. The example lock apparatus described herein provide such a mechanical locking device. In particular, the example lock apparatus may enable the pistons to extend relatively (or completely) unimpeded but may automatically (e.g., mechanically) fix the pistons relative to a shaft, stem, or rack having locking features such as teeth, ridges or detents in response to a retraction movement of the piston and, thus, the standoff coupled thereto, that is not the result of a hydraulic signal to cause retraction. Further, the example lock apparatus described herein may automatically unlock the pistons in response to a hydraulic signal to retract the pistons and standoffs.

FIG. 1 depicts a wellsite system including downhole tool (s) according to one or more aspects of the present disclosure. The wellsite drilling system of FIG. 1 can be employed onshore and/or offshore. In the example wellsite system of FIG. 1, a borehole 11 is formed in one or more subsurface formations by rotary and/or directional drilling.

As illustrated in FIG. 1, a drill string 12 is suspended in the borehole 11 and includes a bottom hole assembly (BHA) 100 having a drill bit 105 at its lower end. A surface system includes a platform and derrick assembly 10 positioned over the borehole 11. The derrick assembly 10 includes a rotary table 16, a kelly 17, a hook 18 and a rotary swivel 19. The drill string 12 is rotated by the rotary table 16, energized by means not shown, which engages the kelly 17 at an upper end of the drill string 12. The example drill string 12 is suspended from the hook 18, which is attached to a traveling block (not shown), and through the kelly 17 and the rotary swivel 19, which permits rotation of the drill string 12 relative to the hook 18. Additionally, or alternatively, a top drive system could be used.

In the example depicted in FIG. 1, the surface system further includes drilling fluid 26, which is commonly referred to in the industry as mud, and which is stored in a pit 27 formed at the well site. A pump 29 delivers the drilling fluid 26 to the interior of the drill string 12 via a port in the rotary swivel 19, causing the drilling fluid 26 to flow downwardly through the drill string 12 as indicated by the directional arrow 8. The drilling fluid 26 exits the drill string 12 via ports in the drill bit 105, and then circulates upwardly through the annulus region between the outside of the drill string 12 and the wall of the borehole 11, as indicated by the directional arrows 9. The drilling fluid 26 lubricates the drill bit 105, carries formation cuttings up to the surface as it is returned to the pit 27 for recirculation, and creates a mudcake layer (not shown) on the walls of the borehole 11.

The example bottom hole assembly 100 of FIG. 1 includes, among other things, any number and/or type(s) of logging-while-drilling (LWD) modules or tools (one of which is designated by reference numeral 120) and/or measuring-while-drilling (MWD) modules (one of which is designated by reference numeral 130), a rotary-steerable system or mud motor 150 and the example drill bit 105. The MWD module 130 measures the drill bit 105 azimuth and inclination that may be used to monitor the borehole trajectory.

The example LWD tool 120 and/or the example MWD module 130 of FIG. 1 may be housed in a special type of drill collar, as it is known in the art, and contains any number of logging tools and/or fluid sampling devices. The example LWD tool 120 includes capabilities for measuring (e.g., properties of a formation F), processing and/or storing information, as well as for communicating with the MWD module 130 and/or directly with the surface equipment, such as, for example, a logging and control computer 160.

The logging and control computer 160 may include a user interface that enables parameters to be input and or outputs to be displayed that may be associated with the drilling operation and/or the formation traversed by the borehole 11. While the logging and control computer 160 is depicted uphole and adjacent the wellsite system, a portion or all of the logging and control computer 160 may be positioned in the bottom hole assembly 100 and/or in a remote location.

Figure 2:
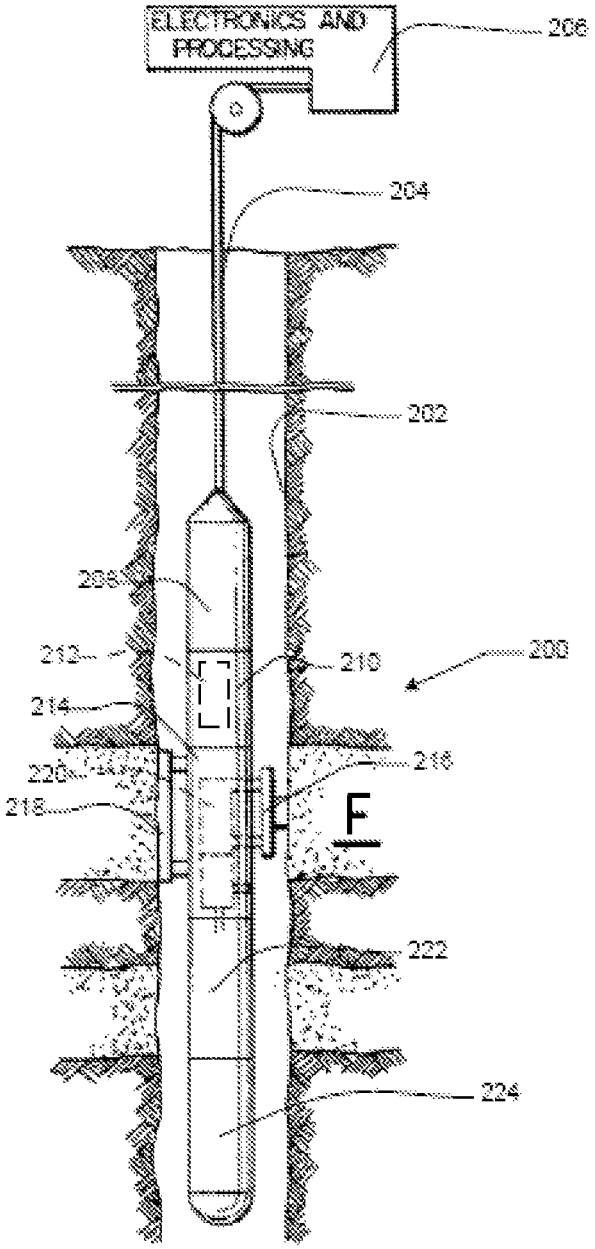
FIG. 2 is a wireline system according to one or more aspects of the present disclosure.

FIG. 2 depicts an example wireline system including downhole tool(s) according to one or more aspects of the present disclosure. The example wireline tool 200 may be used to extract and analyze formation fluid samples and is suspended in a borehole or wellbore 202 from the lower end of a multiconductor cable 204 that is spooled on a winch (not shown) at the surface. At the surface, the cable 204 is communicatively coupled to an electrical control and data acquisition system 206. The tool 200 has an elongated body 208 that includes a collar 210 having a tool control system 212 configured to control extraction of formation fluid from a formation F and measurements performed on the extracted fluid.

The wireline tool 200 also includes a formation tester 214 having a selectively extendable fluid admitting assembly 216 and a selectively extendable tool anchoring member 218 that are respectively arranged on opposite sides of the body 208. The fluid admitting assembly 216 is configured to selectively seal off or isolate selected portions of the wall of the wellbore 202 to fluidly couple to the adjacent formation F and draw fluid samples from the formation F. The formation tester 214 also includes a fluid analysis module 220 through which the obtained fluid samples flow. The fluid may thereafter be expelled through a port (not shown) or it may be sent to one or more fluid collecting chambers 222 and 224, which may receive and retain the formation fluid for subsequent testing at the surface or a testing facility.

In the illustrated example, the electrical control and data acquisition system 206 and/or the downhole control system 212 are configured to control the fluid admitting assembly 216 to draw fluid samples from the formation F and to control the fluid analysis module 220 to measure the fluid samples. In some example implementations, the fluid analysis module 220 may be configured to analyze the measurement data of the fluid samples as described herein. In other example implementations, the fluid analysis module 220 may be configured to generate and store the measurement data and subsequently communicate the measurement data to the surface for analysis at the surface. Although the downhole control system 212 is shown as being implemented separate from the formation tester 214, in some example implementations, the downhole control system 212 may be implemented in the formation tester 214.

One or more modules or tools of the example drill string 12 shown in FIG. 1 and/or the example wireline tool 200 of FIG. 2 may employ the example methods and apparatus described herein. While the example apparatus and methods described herein are described in the context of drillstrings and/or wireline tools, they are also applicable to any number and/or type(s) of additional and/or alternative downhole tools such as coiled tubing deployed tools.

Figure 3:
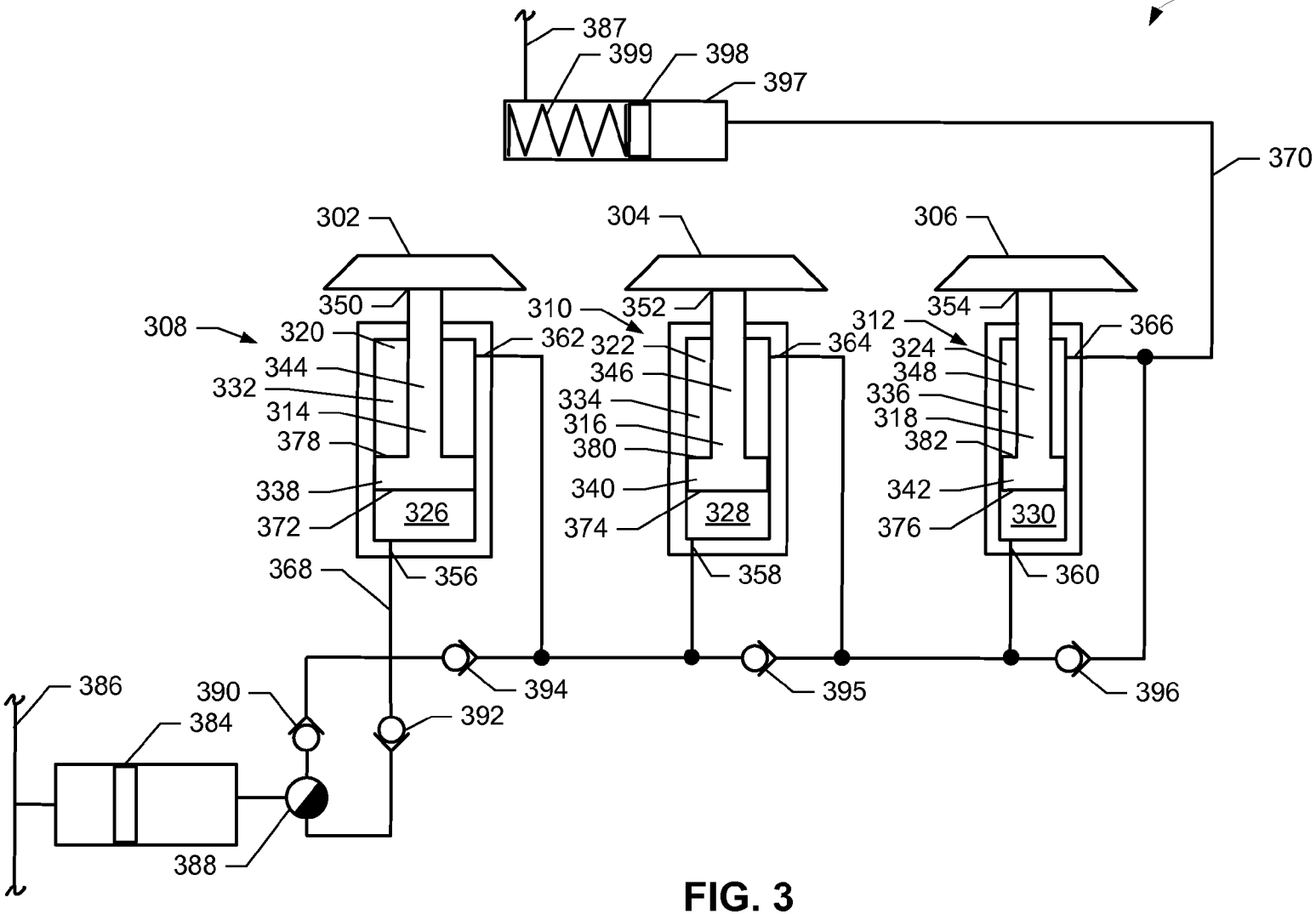
FIG. 3 is a schematic view of apparatus according to one or more aspects of the present disclosure.

FIG. 3 is a schematic diagram depicting an example hydraulic circuit 300 that may be used to hydraulically actuate a plurality of standoffs 302-306 for use with a downhole tool in accordance with the teachings of this disclosure. The example hydraulic circuit 300 includes a plurality of hydraulic actuators 308-312, each of which includes a respective hydraulically actuated piston 314-318. The pistons 314-318 slide within respective bores 320-324 and define respective first chambers 326-330 and respective opposing second chambers 332-336 within the bores 320-324. Each of the pistons 314-318 has a head portion 338-342 and a stem portion 344-348. The stem portions 344-348 extend away from the head portions 338-342 and through the second chambers 332-336 such that ends 350-354 of the stem portions 344-348 extend outside the second chambers 332-336 to engage respective ones of the standoffs 302-306. In this manner, the pistons 314-318 are operatively coupled to respective ones of the standoffs 302-306 to extend and retract the standoffs 302-306 as described in greater detail below. While this example depicts the use of three hydraulic actuators coupled to first through third respective standoffs 302-306, other implementations may use more or fewer actuators and/or standoffs to suit the needs of a particular application.

The first chambers 326-330 include respective first fluid ports 356-360 and the second chambers 332-336 include respective second fluid ports 362-366. In operation, fluid may be provided to the first chambers 326-330 via the first ports 356-360 to cause the pistons 314-318 to move upward in the orientation of FIG. 3 to extend the standoffs 302-306. Similarly, fluid may be provided to the second chambers 332-336 via the second ports 362-366 to cause the pistons 314-318 to move downward to retract the standoffs 302-306.

The fluid ports 356-366 may be interconnected as shown in the example of FIG. 3 to hydraulically serially couple the pistons 314-318 so that a hydraulic signal applied to a set line 368 coupled to the first port 356 of the first hydraulic actuator 308 causes all of the pistons 314-318 and, thus, the standoffs 302-306 to move or extend at the same time. In particular, as shown in FIG. 3, the second fluid port 362 of the first hydraulic actuator 308 is coupled to the first fluid port 358 of the second hydraulic actuator 310, and the second fluid port 364 of the second hydraulic actuator 310 is coupled to the first fluid port 360 of the third hydraulic actuator 312. Thus, as fluid enters the first port 356 and chamber 326 of the first hydraulic actuator 308, the piston 314 moves upward to extend the first standoff 302 and the fluid in the second chamber 332 of the first hydraulic actuator 308 is expelled via the second port 362 of the first hydraulic actuator 308. The fluid expelled via the second port 362 of the first hydraulic actuator 308 enters the first chamber 328 of the second hydraulic actuator 310 via the first port 358 of the second hydraulic actuator 304. In turn, the fluid entering the first chamber 328 of the second hydraulic actuator 310 causes the piston 316 of the second hydraulic actuator 310 to move upward and extend the second standoff 304 and expel fluid from the second chamber 334 of the second hydraulic actuator 310 via the second port 364 of the second hydraulic actuator 310. The fluid expelled via the second port 364 of the second hydraulic actuator 310 enters the first chamber 330 of the third hydraulic actuator 312, thereby causing the piston 318 of the third hydraulic actuator 312 to move upward and extend the third standoff 306.

To retract the pistons 314-318 and the standoffs 302-306, a hydraulic signal may be applied to a retract line 370, which is coupled to the second port 366 of the third hydraulic actuator 312. The hydraulic signal applied to the retract line 370 causes the piston 318 of the third hydraulic actuator 312 to move downward (and the third standoff 306 to retract), thereby causing fluid to be expelled from the first port 360 of the third hydraulic actuator 312. The fluid expelled from the first port 360 of the third hydraulic actuator 312 flows into the second port 364 of the second hydraulic actuator 310 to cause the piston 316 of the second hydraulic actuator 310 to move downward (and the second standoff 304 to retract), thereby causing fluid to be expelled via the first port 358 of the second hydraulic actuator 310. The fluid expelled via the first port 358 of the second hydraulic actuator 310 flows into the second port 362 of the first hydraulic actuator 308, thereby causing the piston 314 of the first hydraulic actuator 308 to move downward to retract the first standoff 302.

In addition to serially coupling the hydraulic actuators 308-312 to enable simultaneous extension or retraction of the standoffs 302-306 in response to a single hydraulic signal applied to the set line 368 or the retract line 370, the hydraulic actuators 308-312 are also differently (e.g., proportionally) sized so that the standoffs 302-306 are extended or retracted at the same or at least substantially the same rate and amount. More specifically, the pistons 314-318 have respective first sides 372-376, which are exposed to the first chambers 326-330, and respective second sides 378-382, which are exposed to the second chambers 332-336. Each of the sides 372-382 has a respective effective surface area, which corresponds to the area against which a pressurized fluid in the chambers 326-336 exerts a force on the pistons 314-318 to urge the pistons 314-318 to extend or retract the standoffs 302-306 (e.g., an upwardly or downwardly directed force in the orientation of FIG. 3). In general, the effective surface areas of the first sides 372-376 are greater than the effective surface areas of the opposing respective second sides 378-382 due to the area occupied by the stem portions 344-348 on the second sides 378-382. Also, as generally represented in FIG. 3, the effective surface areas of the first sides 372-376 decrease from the first hydraulic actuator 308 to the third hydraulic actuator 312.

To enable the standoffs 302-306 to be extended at substantially the same rate and amount in response to a hydraulic signal applied to the set line 368 or the retract line 370, the effective surface area of the first side 374 of the second piston 316 is substantially equal to the effective surface area of the second side 378 of the first piston 314. Likewise, the effective surface area of the first side 376 of the third piston 318 is substantially equal to the effective surface area of the second side 380 of the second piston 316.

The hydraulic signals(s) applied to the set line 368 may be provided by a pump or flowline piston 384, which may be coupled to a flowline 386 located, for example, in another portion of a toolstring separate from the portion of the toolstring to which the hydraulic actuators 308-312 and the standoffs 302-306 are coupled. By using a source for the hydraulic signal in another portion of a toolstring, the overall size or envelope of a tool or drill collar containing the standoffs 302-306 can be significantly reduced or minimized. However, if desired, a source for the hydraulic signal applied to the set line 368 can instead be located within the tool or drill collar housing to which the standoffs 302-306 are coupled.

The flowline piston 384 is coupled to the set line 368 via a three-way solenoid valve 388 and first and second check valves 390 and 392. Additionally, third, fourth and fifth check valves or relief valves 394-396 may be included as shown to shunt across the first and second fluid ports 356-366 and to provide a fluid path from the retract line 370 to the set line 368 during a retract operation to ensure that the first chambers 326-330 are emptied of fluid which, in turn, ensures that all of the pistons 314-318 and the standoffs 302-306 have been substantially fully retracted. In FIG. 3, the three-way valve 388 is shown in a position to retract the standoffs 302-306.

The retract line 370 is fluidly coupled to an oil reservoir 397 having a compensator piston 398 and a compensator spring 399. The compensator spring side of the compensator piston 398 may be coupled to borehole pressure 387. When retracting the standoffs 302-306, the compensator spring 399 (assisted by the borehole pressure) urges fluid into the second fluid port 366 of the third hydraulic actuator 312 to retract the third standoff 306. As described above, the first and second hydraulic actuators 308 and 310 are also caused to retract the respective standoffs 302 and 304. The flowline piston 384 may also be operated to facilitate the retraction operation by emptying the first chambers 326-330 and shunting across the set line 368 and the retract line 370 via the check valves 390, 394, 395 and 396.

The example hydraulic circuit 300 shown in FIG. 3 may be included within a downhole tool, for example, the tools 100 and/or 200 of FIGS. 1 and 2. When included with a downhole tool or toolstring, the example hydraulic circuit 300 can be commanded via, for example, one or more hydraulic signals applied to the set line 368 to extend the standoffs 302-306 away from an outer surface of a body of the tool to centralize the tool and/or to unstick the tool from a wall of a borehole in which the tool is disposed. As described below in more detail, the standoffs 302-306 may be sized and configured so that when the standoffs are fully retracted, the standoffs lie within an outer envelope of the body of the tool, thereby enabling the tool to be safely used in relatively small diameter boreholes.

Further, multiple hydraulic circuits similar or identical to the example circuit 300 of FIG. 3 may be included along a toolstring such that the toolstring includes multiple portions or tools spaced along the toolstring and having a plurality of standoffs distributed about an outer surface of the tools at their respective locations along the toolstring.

Figure 5:
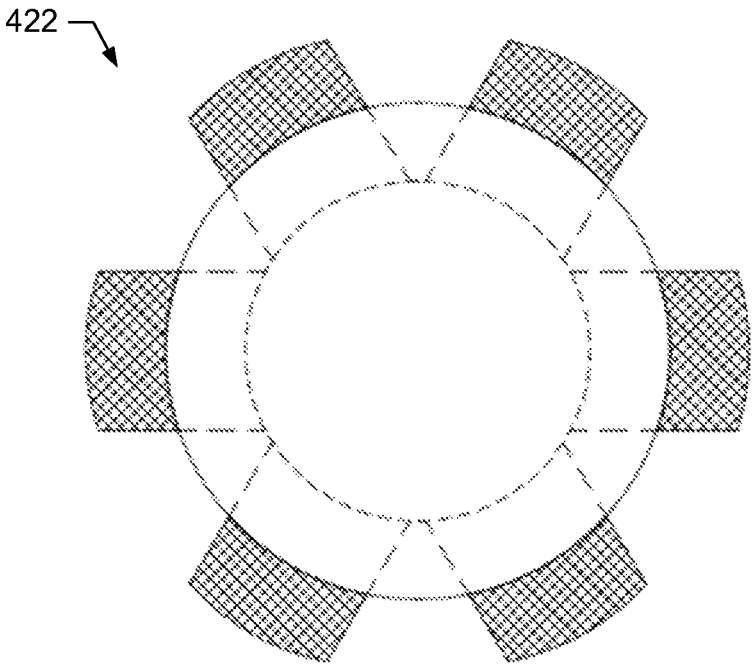
FIGS. 4 and 5 depict apparatus according to one or more aspects of the present disclosure.
Figure 4:
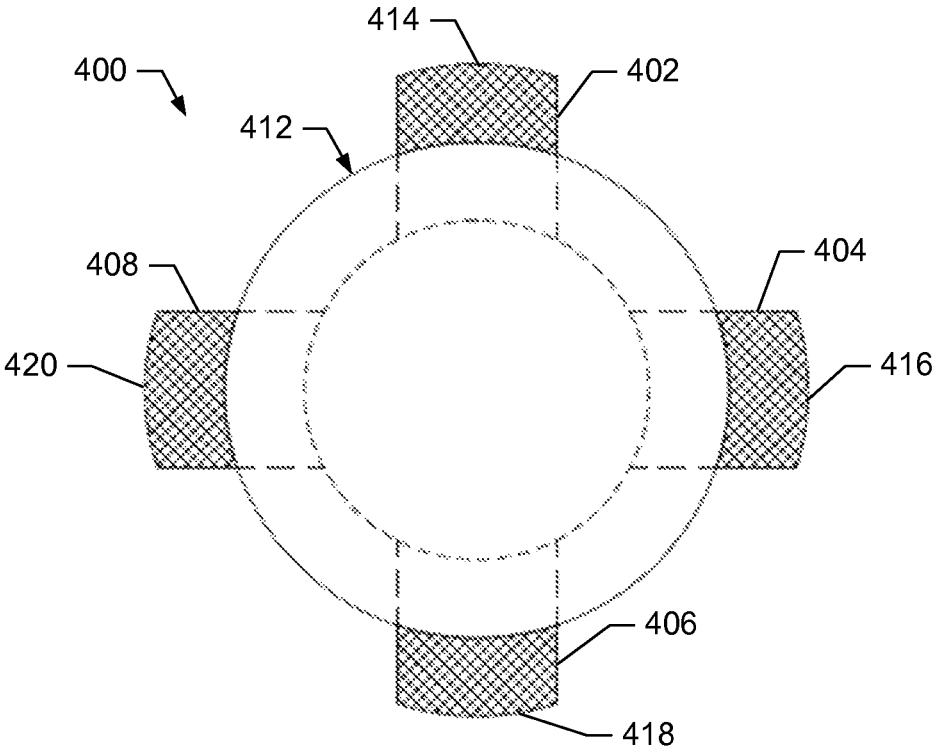

FIGS. 4 and 5 depict example configurations for standoffs that may be used in conjunction with a hydraulic circuit similar to the example hydraulic circuit 300 of FIG. 3. FIG. 4 depicts a plan view of a four standoff configuration 400. The configuration 400 includes standoffs 402-408 distributed evenly about an outer surface 410 of a tool or drill collar 412. In this example, the standoffs 402-408 have curved or tapered outer surfaces 414-420 to engage the curvature of a borehole wall. Additionally, the standoffs 402-408 are dimensioned and configured so that when the standoffs 402-408 are fully retracted, the outer surfaces 414-420 are within an envelope or diameter of the tool or drill collar 412. Of course, because the configuration 400 includes four standoffs, the hydraulic circuit 300 of FIG. 3 may be modified to include a fourth serially hydraulically coupled hydraulic actuator for use with the configuration 400.

The dimensions and/or extension distance of the standoffs 402-408 (i.e., the distance the standoffs extend beyond the envelope of the tool) may be selected to provide improved or optimal standoff performance for different borehole diameters. In general, the standoff extension distance may be selected so that when the standoffs are fully extended, the effective outer diameter of the tool is near to or equal to the nominal borehole diameter. For example, in a case where the standoffs 402-408 are configured for use with a tool having a 4.75" diameter, the standoffs 402-408 may be sized to extend 0.75" from the outer surface of the tool. In this case, the effective standoff distance is 0.28" against a flat surface or 0.49" in a 12.25" borehole. More generally, as the borehole diameter approaches the effective diameter of the tool with the standoffs 402-408 fully extended, the effective standoff distance approaches the 0.75" standoff extension distance. In another example where the borehole diameter is 5.875", the standoffs 402-408 may be dimensioned or sized to provide a 0.562" extension beyond the outer envelope of the tool 412. In this example, the tool 412 would be precisely centered within an in-gauge borehole.

A six standoff configuration 422 is shown in FIG. 5. The six standoff configuration 422 can be used to generate a greater amount of standoff force and better overall standoff performance than the four standoff configuration 400 of FIG. 4. For example, with the six standoff configuration 422, in a 12.25" borehole, the effective standoff distance is 0.68". Further, with the six standoff configuration 422 of FIG. 5, three standoffs may be engaged with the borehole wall to generate over 12,000 pounds of pushing force away from the borehole wall given a hydraulic signal pressure of 4000 psi.

Figure 6:
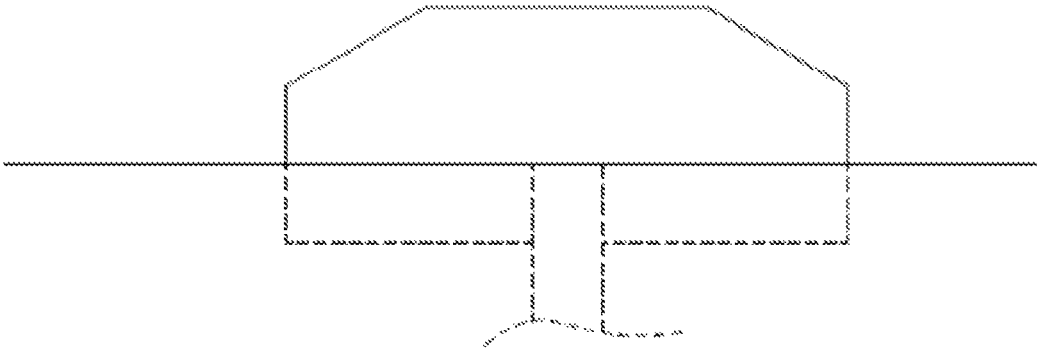
FIGS. 6 and 7 depict apparatus according to one or more aspects of the present disclosure.
Figure 7:
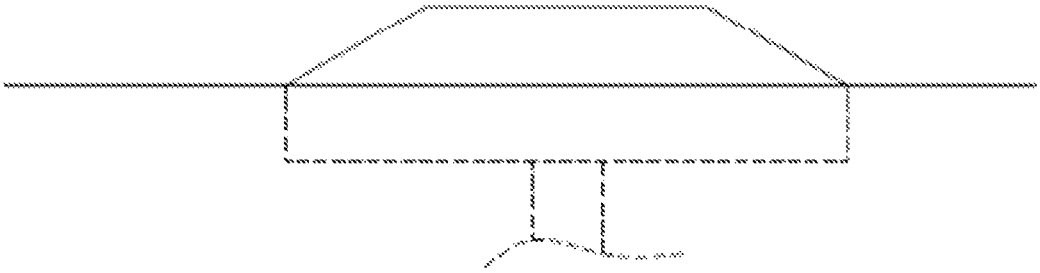

For borehole sizes greater than 7", the standoffs when fully refracted may extend outside the envelope of the tool to provide a base standoff distance. However, in cases where the standoffs do not fully retract to within the envelope of the tool, the standoff may have a shape or profile similar to that shown in FIGS. 6 and 7.

Figure 8:
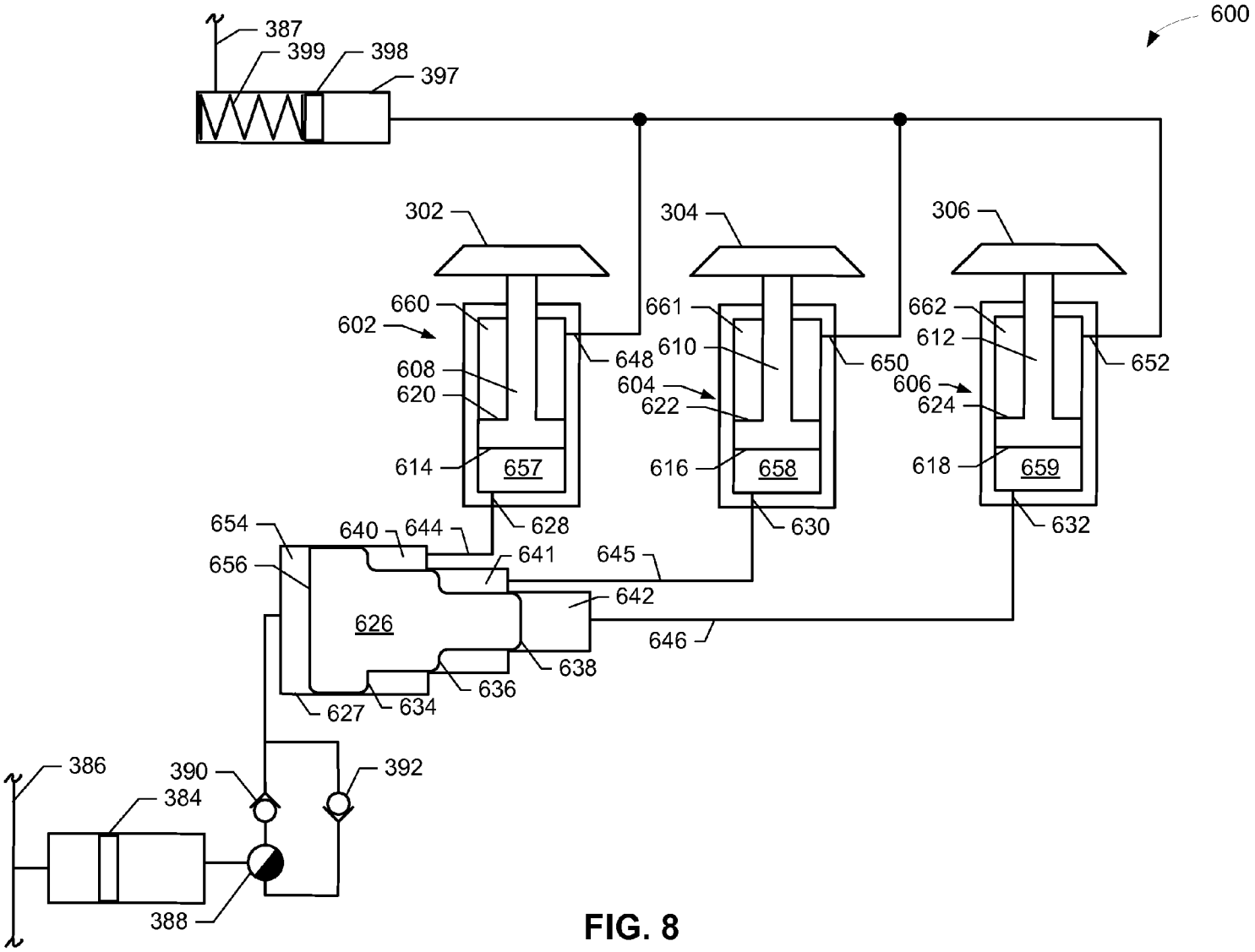
FIG. 8 depicts apparatus according to one or more aspects of the present disclosure.

FIG. 8 depicts another example hydraulic circuit 600 that may be used to extend and retract the plurality of standoffs 302-306 in accordance with the teachings of this disclosure. As shown in FIG. 8, the example hydraulic circuit 600 includes a plurality of hydraulic actuators 602-606, each of which is coupled to a respective one of the standoffs 302-306. In contrast to the example circuit 300 of FIG. 3, the hydraulic actuators 602-606 of the example circuit 600 of FIG. 6 have identically or at least substantially similarly sized pistons 608-612. Thus, the effective areas of first sides 614-618 of the pistons 608-612 are substantially equal as are the effective areas of opposing second sides 620-624 of the pistons 608-612.

Further, the example circuit 600 of FIG. 8 includes a stepped piston 626 interposing the flowline piston 384 and first ports 628-632 of the hydraulic actuators 602-606. The stepped piston 626 moves in a stepped bore 627 and includes a plurality of integral pistons, piston portions, or piston surfaces 634-638 having substantially equal effective surface areas. Each of the integral pistons, piston portions or piston surfaces 634-638 defines a respective chamber 640-642 that is fluidly coupled via hydraulic paths or lines 644-646 to respective ones of the first ports 628-632. Additionally, second ports 648-652 of the hydraulic actuators 602-606 are coupled to the oil reservoir 397.

In operation, to extend the standoffs 302-306, the flowline piston 384 may move to the right (in the orientation of FIG. 8), thereby moving hydraulic fluid into a chamber 654 adjacent a drive surface 656 of the stepped piston 626. In turn, the stepped piston 626 moves to cause fluid to be driven by the piston surfaces 634-638 through the lines 644-646, through the first ports 628-632 and into first chambers 657-659 of the hydraulic actuators 602-606. The amount of fluid flowing into each of the first chambers 657-659 is substantially the same and, thus, the pistons 608-612 of the hydraulic actuators 602-606 move at substantially the same rate and substantially the same amount to extend the standoffs 302-306. As the pistons 608-612 extend, fluid is driven out of second chambers 660-662 via respective ones of the second ports 648-652 to the oil reservoir 397, thereby moving the compensator piston 398 to the left to further compress the compensator spring 399.

To retract the standoffs 302-306, the flowline piston 626 moves to the left in the orientation of FIG. 8 to draw fluid out of the chamber 654 adjacent the drive surface 656 of the stepped piston 626. This causes the piston 626 to move to the left to draw fluid from the first chambers 657-659 of the hydraulic actuators 602-606 into respective ones of the chambers 640-642 corresponding to the piston surfaces 634-638. As a result, the pistons 608-612 retract along with the standoffs 302-306 and fluid flows from the oil reservoir 397 into the second chambers 660-662.

Figure 9:
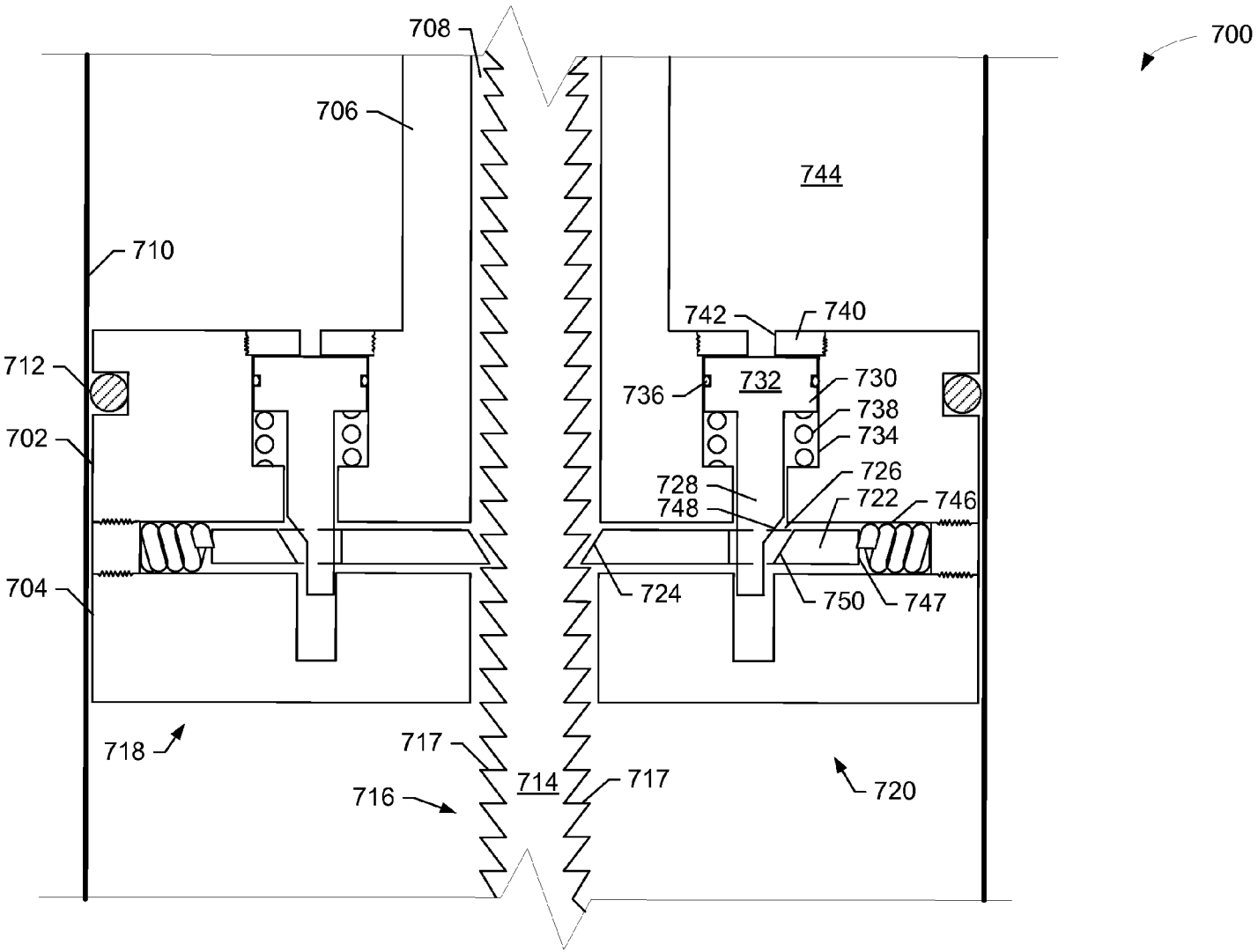
FIG. 9 depicts apparatus according to one or more aspects of the present disclosure.

FIG. 9 depicts a partial cross-sectional view of an example locking piston configuration 700 that may be used to implement any or all of the pistons coupled to standoffs described herein. The example configuration 700 includes a piston 702 having a head portion 704 and a stem portion 706. The stem portion 706 includes a bore 708 therethrough. The piston 702 moves or slides relative to a bore 710 and is sealingly engaged with the bore 710 via a seal (e.g., o-ring) 712. A shaft, stem or rack 714 extends through the bore 706 of the stem 704 and has an outer toothed surface 716. The toothed surface 716 may have a saw-toothed shaped profile as shown or any other surface including a plurality of relatively raised surface portions configured to provide a series of locking surfaces 717 along the length of the stem, shaft or rack 714.

The example locking piston configuration 700 of FIG. 9 includes lock mechanisms or locks 718 and 720. However, while two locks 718 and 720 are depicted in the example of FIG. 9, one lock or more than two locks may be used instead to suit the needs of a particular application. Further, the locks 718 and 720 are identical and, thus, for the sake of brevity, only one of the locks 718 and 720 will be described in detail. Turing in detail to the lock 720 shown on the right side of FIG. 9, the lock 720 includes a locking pin 722 having a first end 724 shaped to engage the locking surfaces 717 of the toothed surface 716. The locking pin 722 also includes an opening 726 through which a stem 728 of a release piston 730 passes. A head 732 of the release piston 730 slides in a bore 734 and is sealingly engaged with the bore 734 via a seal (e.g., o-ring) 736. A spring 738 biases the release piston 730 toward a stop 740 having an aperture 742 therethrough to expose the head 732 of the release piston 730 to an upper chamber 744. The upper chamber 744 may correspond to, for example, one of the standoff piston second chambers 320-324 and 660-662 of FIGS. 3 and 8. Another spring 746 biases a second end 747 of the locking pin 722 toward the toothed surface 716 of the rack 714.

In operation, due to the profile of the toothed surface 716, the piston 702 may be moved upward (in the orientation of FIG. 9) to, for example, extend a standoff coupled to the stem 706. The first end 724 and the toothed surface 716 may be shaped (e.g., beveled) in a complementary manner as shown in FIG. 9 to permit the locking pin 722 to follow the profile of the toothed surface 716 as the piston 702 moves upward. In this manner, as the piston 702 moves upward, the locking pin 722 moves outward and inward to follow the saw-tooth profile 716, thereby allowing relatively free movement of the piston 702 in the upward direction (i.e., to extend a standoff). However, with the release piston 730 in the position shown in FIG. 9, the complementary shapes of the first end 724 and the toothed surface 716 prevent the downward movement of the piston 702, thereby locking the piston in the uppermost (i.e., most extended position) to which it is hydraulically driven.

When a retraction operation is performed, a fluid pressure in the upper chamber 744 increases and, via the aperture 742, applies a pressure to the release piston 730 to cause the release piston 730 to move downward in the orientation of FIG. 9. This downward movement drives the stem 706 further into the opening 726 of the locking pin 722 and a beveled surface 748 of the stem 728 engages a beveled surface 750 within the opening 726 to move the pin 722 against the spring 746 to the right. The pin 722 is moved sufficiently far so that the first end 724 of the locking pin 722 is disengaged from (i.e., is clear of) the toothed surface 716 of the rack 714, thereby enabling the piston 702 to move downward to retract the standoff. While the example locking pin 722 shown in FIG. 9 is configured to slide relative to the toothed surface 716 of the rack 714, the locking pin 722 could instead be hinged to pivot relative to the toothed surface 716 of the rack 714 and the stem 704 and, in that case, would drive the locking pin to pivot to disengage the hinged locking pin from the toothed surface 716.

Figure 10:
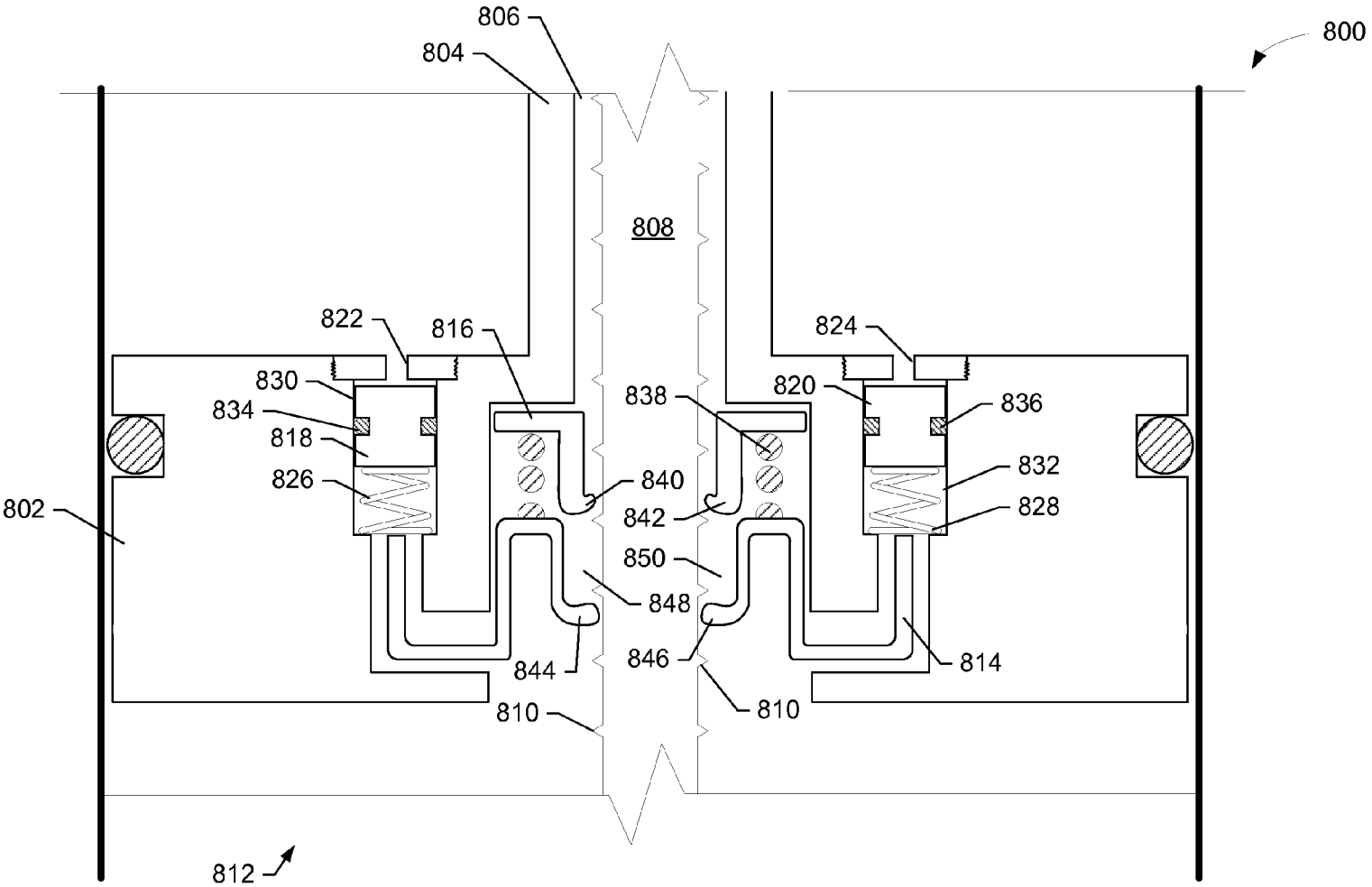
FIG. 10 depicts apparatus according to one or more aspects of the present disclosure.

FIG. 10 depicts another example locking piston configuration 800. In the example configuration 800 of FIG. 10, a piston 802 has a stem 804 with a bore 806 therethrough to slidably receive a shaft or stem 808 having a plurality of raised rings or ridges 810. A locking mechanism or lock 812 includes a lock ring 814, a support ring 816 and release pistons 818 and 820. The release pistons 818 and 820 are biased toward apertures 822 and 824 by springs 826 and 828. Additionally, the pistons 818 and 820 slide within bores 830 and 832 and are sealingly engaged with the bores 830 and 832 via seals 834 and 836. Another spring 838 biases the lock ring 814 away from the support ring 816 as shown in FIG. 10.

In operation, when moving the piston 802 upward (e.g., to extend a standoff), with the release pistons 818 and 820 in the positions shown in FIG. 10, fingers 840 and 842 of the support ring 816 and fingers 844 and 846 of the lock ring 814 are forced outward as the fingers 840-846 ride over the ridges 810, thereby permitting relatively unimpeded movement of the piston 802 upward in the orientation of FIG. 10. However, if the piston 802 is urged downward with the release pistons 818 and 820 as shown in FIG. 10, the spring 838 biasing the lock ring 814 and the support ring 816 apart is sufficiently weak to prevent the downward movement of the support ring 816 from applying sufficient force to the lock ring 814 to cause the fingers 844 and 846 of the lock ring 814 to move outward and over the ridges 810. As a result, the spring 838 between the lock ring 814 and the support ring 816 is compressed and the fingers 840 and 842 of the support ring 816 move to fill spaces 848 and 850 between the fingers 844 and 846 of the lock ring 814 and the shaft 806. In this manner, the fingers 840 and 842 of the support ring 816 are prevented from moving outward, thereby preventing further downward movement of the support ring 816 when the fingers 840 and 842 of the support ring 816 engage one of the ridges 810. To release the locked condition, hydraulic pressure is applied to the release pistons 818 and 820 via the apertures 822 and 824 to move the pistons 818 and 820 downward, thereby moving the lock ring 814 downward and away from the support ring 816. Separation of the lock ring 814 and the support ring 816 removes the fingers 840 and 842 of the support ring from the spaces 848 and 850 to enable the fingers 840 and 842 to move outward and ride over the ridges 810 as the piston 802 is moved downward.

Figure 11:
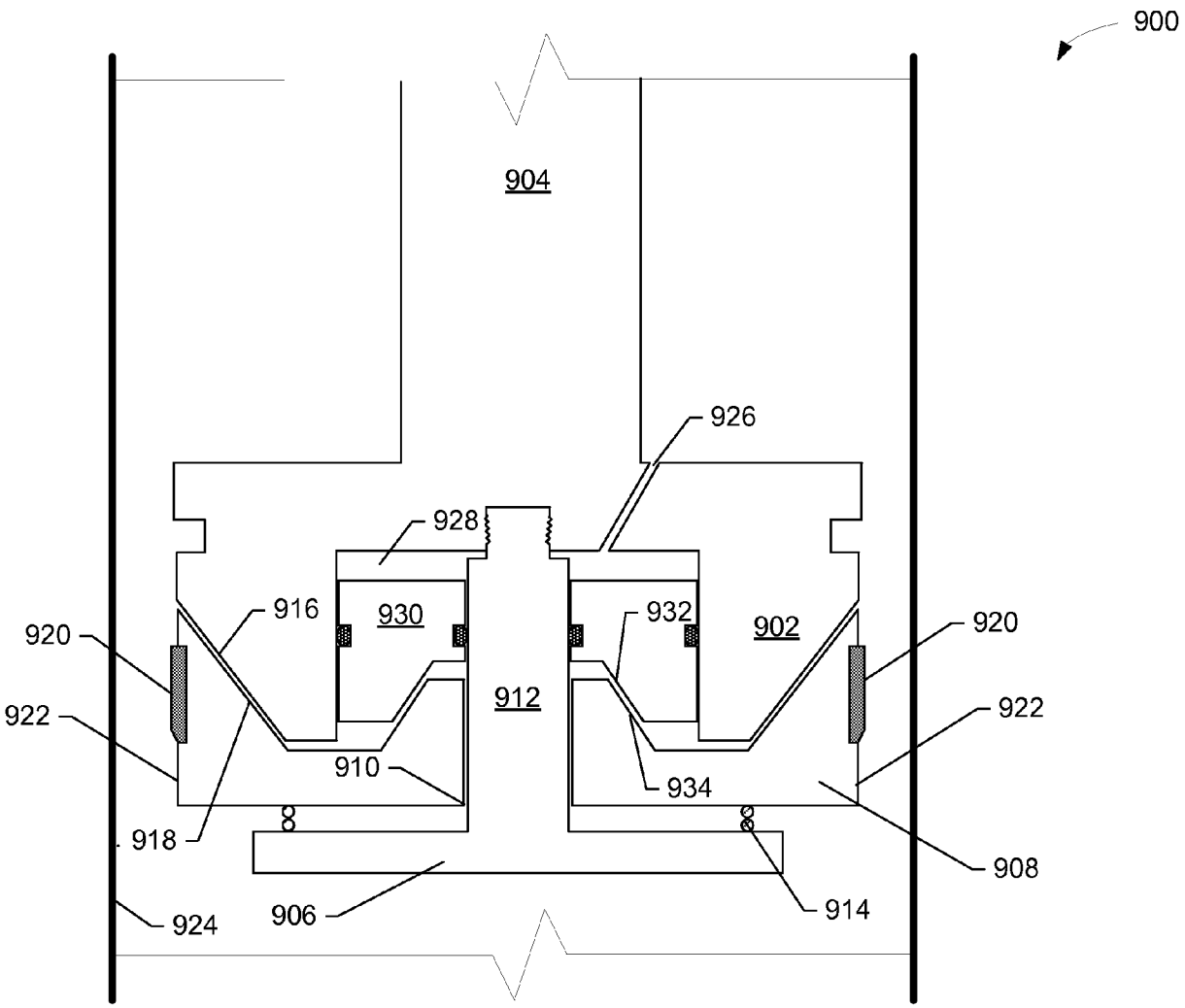
FIG. 11 depicts apparatus according to one or more aspects of the present disclosure.

FIG. 11 depicts yet another example locking piston configuration 900. The example configuration 900 of FIG. 11 includes a piston 902 having a stem 904 and a support bolt 906 threadably engage to the piston 902. A lock ring 908, which is composed of multiple separate segments, includes a central aperture 910 through which a shaft 912 of the support bolt 906 passes. An actuation spring 914 biases the lock ring 908 toward a beveled surface 916 of the piston 902. The lock ring 908 includes outer beveled surfaces 918 to engage the beveled surface 916 of the piston 908, which engagement causes the segments of the lock ring 908 to move outward so that elastomeric inserts 920 on a peripheral surface 922 of the lock ring 908 frictionally engages a bore 924 in which the piston 902 slides.

In operation, upward movement of the piston 902 causes the lock ring 908 to move away from the piston 902 to compress the actuation spring 914. This separation of the lock ring 908 and the piston 902 enables the segments of the lock ring 908 to move inward, thereby pulling the elastomeric inserts 920 away from frictional engagement with the bore 924 to permit relatively unimpeded upward movement of the piston 902. However, if the piston 902 is urged downward, the beveled surface 916 of the piston 902 engages the outer beveled surfaces 918 of the lock ring 908 to cause the segments of the lock ring 908 to move outward, thereby causing the elastomeric inserts 920 to frictionally engage the bore 924. The material used for the inserts 920 is selected to provide sufficient friction to substantially prevent downward movement of the piston 902 until a retraction hydraulic signal is provided. The material used for the inserts 920 is also selected so that engagement of the inserts 920 with the bore 924 does not damage the bore 924.

When a refraction hydraulic signal is provided to the configuration 900 of FIG. 11, the hydraulic pressure associated with the retraction signal passes through an aperture 926 in the piston 902 and into a chamber 928 within the piston 902. A release piston 930 within the chamber 928 is urged downward by the retraction signal to cause a beveled surface 932 of the release piston 920 to engage an inner beveled surface 934 of the lock ring 908 to move the segments of the lock ring 908 inward. Such inward movement of the segments disengages the elastomeric inserts 920 from the bore 924 to permit relatively unimpeded movement of the piston 902 downward to retract, for example, a standoff coupled to the stem 904 of the piston 902. Although not shown, one or more bias springs may be provided between the lock ring 908 and the release piston 930 to bias the lock ring 908 and the release piston 930 apart.

While the foregoing examples are described in connection with sampling tools or operations, the examples described herein may be used in connection with any other types of tools and/or operations.

The present disclosure introduces a downhole tool having a body defining an outer surface and a plurality of standoffs distributed about the outer surface. A hydraulic circuit may be operatively coupled to the standoffs. The hydraulic circuit includes a plurality of hydraulically actuated pistons, each of which is operatively coupled to a respective one of the standoffs to extend and retract the respective standoff. The pistons are hydraulically coupled and sized to extend or retract the respective standoffs at substantially the same rate in response to a hydraulic control signal.

The present disclosure also introduces a system including a toolstring to be disposed in a borehole, and a first tool coupled to the toolstring. The first tool includes a plurality of standoffs distributed about an outer surface of the first tool and a plurality of pistons operatively coupled to the standoffs. The pistons are differently sized to extend or retract the standoffs at substantially the same rate in response to a hydraulic signal applied to one of the pistons.

The present disclosure further introduces a method involving disposing a tool in a borehole, applying a first hydraulic signal to one of a plurality of differently sized pistons to extend a plurality of standoffs at substantially the same rate, where each of the pistons is operatively coupled to a respective one of the standoffs, and applying a second hydraulic signal to another one of the pistons to retract the plurality of standoffs.

The present disclosure also introduces an apparatus comprising: a downhole tool having a body defining an outer surface; a plurality of standoffs distributed about the outer surface; and a hydraulic circuit operatively coupled to the standoffs, the hydraulic circuit including a plurality of hydraulically actuated pistons, each of which is operatively coupled to a respective one of the standoffs to extend and retract the respective standoff, wherein the pistons are hydraulically coupled and sized to extend or retract the respective standoffs at substantially the same rate in response to a hydraulic control signal. Each of the pistons may slide within a bore and define first and second opposing chambers within the bore, wherein each of the first chambers may include a respective first fluid port and each of the second chambers may include a respective second fluid port. The hydraulic control signal may be coupled to the first fluid port of the first chamber defined by a first one of the pistons, wherein the second fluid port of the second chamber defined by the first one of the pistons may be fluidly coupled to the first fluid port of the first chamber defined by a second one of the pistons. Each of the pistons may include a head portion and a stem portion extending away from the head portion and through the second chamber such that an end of the stem portion extends outside the second chamber to engage the respective standoff. Each of the head portions may have a first side having a first effective surface area exposed to the first chamber and a second side having a second effective surface area exposed to the second chamber, the second effective surface area being smaller than the first effective surface area. The second effective surface area of the first piston may be substantially equal to the first effective surface area of the second piston. The second fluid port of the second chamber defined by the second piston may be fluidly coupled to the first fluid port of the first chamber defined by a third one of the pistons, wherein the second effective surface area of the second piston may be substantially equal to the first effective surface area of the third piston, and wherein the first second and third pistons may extend to centralize the downhole tool relative to a borehole wall or to unstick the downhole tool from the borehole wall. Each of the first chambers may receive fluid to extend the respective standoff, and each of the second chambers may receive fluid to retract the respective standoff. The first fluid port of the first chamber defined by one of the pistons may be fluidly coupled to a set line, and the second fluid port of a second chamber defined by another one of the pistons may be coupled to a retract line, wherein the hydraulic control signal may be coupled to the set line or the retract line. The apparatus may further comprise a plurality of valves, each of which may be fluidly coupled between the first and second fluid ports of the first and second chambers defined by a respective one of the pistons to provide a fluid path between the set line and the retract line, the fluid path to enable removal of fluid from the first chambers to substantially fully retract the standoffs. The retract line may be fluidly coupled to an oil reservoir. The set line may be fluidly coupled to a flowline piston. The flowline piston may be located in another tool coupled to the downhole tool. The pistons may be integrated within a stepped piston. The apparatus may further comprise a plurality of locks, each of which may be coupled to a respective one of the pistons to hold the respective piston in an extended position.

The present disclosure also introduces a system comprising: a toolstring to be disposed in a borehole; and a first tool coupled to the toolstring, the first tool comprising: a plurality of standoffs distributed about an outer surface of the first tool; and a plurality of pistons operatively coupled to the standoffs, the pistons being differently sized to extend or retract the standoffs at substantially the same rate in response to a hydraulic signal applied to one of the pistons. The hydraulic signal may be provided by a second tool coupled to the toolstring. The standoffs, when fully retracted, may lie within an outer envelope of a body of the tool and the standoffs, when fully extended, may centralize the tool or unstick the tool from a wall of the borehole.

The present disclosure also introduces a method comprising: disposing a tool in a borehole; applying a first hydraulic signal to one of a plurality of differently sized pistons to extend a plurality of standoffs at substantially the same rate, each of the pistons being operatively coupled to a respective one of the standoffs; and applying a second hydraulic signal to another one of the pistons to retract the plurality of standoffs. Applying the first hydraulic signal may comprise applying the first hydraulic signal in response to a command to centralize the tool or to unstick the tool. Applying the first hydraulic signal may comprise operating a pump or a piston in another portion of the tool separate from the portion of the tool including the pistons and the standoffs.

The present disclosure also introduces an apparatus comprising a hydraulic actuator which comprises: a first piston having a head portion and stem portion, the stem portion having a first bore therethrough; a shaft slidably coupled to the first bore, the shaft including a plurality of raised surface portions; and a lock disposed in the head portion of the first piston, the lock to engage the raised surface portions of the shaft to enable the movement of the first piston within a second bore in a first direction and to prevent the movement of the first piston within the second bore in a second direction opposite the first direction. The raised surface portions may comprise a toothed-surface, raised rings or ridges. The lock may comprise a second piston disposed in the head portion of the first piston, the second piston to disengage the lock to enable the first piston to move in the second direction. The second piston may be responsive to a hydraulic pressure to disengage the lock. The lock may comprise a spring to bias the lock toward a locked condition. The lock may comprise a locking pin to engage the raised surface portions of the shaft. The locking pin may comprise an end shaped to complement a profile of the shaft. The locking pin may include an aperture to receive a stem of the second piston so that a movement of the stem of the second piston causes the locking pin to disengage from the raised surface portions. The lock may comprise first and second rings having respective fingers to engage the raised surface portions of the shaft. The first and second rings may move toward one another so that the fingers of the first ring prevent movement of the fingers of the second ring to prevent movement of the first piston in the second direction.

The present disclosure also introduces an apparatus comprising a hydraulic actuator that comprises: a first piston slidably coupled to a bore; and a lock ring having a peripheral surface including an insert, wherein the lock ring is operatively coupled to the first piston to cause the insert to frictionally engage the bore to prevent movement of the first piston. The lock ring may comprise a plurality of segments that move outward toward the bore when the first piston moves in a first direction and inward away from the bore when the first piston moves in a second direction opposite the first direction. The first piston and the lock ring may have respective beveled surfaces that engage to cause the segments of the lock ring to move outward toward the bore when the first piston moves in the first direction. The lock ring may include an aperture to receive a bolt to operatively couple the lock ring to the first piston. The apparatus may further comprise a second piston slidably disposed within a chamber of the first piston, the second piston to engage the lock ring to cause the lock ring to disengage from the bore to enable movement of the first piston. The apparatus may further comprise an aperture in the first piston to couple a hydraulic fluid pressure to the chamber to enable the second piston to move in response to the hydraulic fluid pressure.

The present disclosure also introduces an apparatus comprising a hydraulic actuator that comprises: a piston slidably coupled to a bore; and a means to engage a surface of the hydraulic actuator to prevent the movement of the piston within the bore, the means to engage being coupled to the piston. The means to engage may comprise a locking pin, fingers of a ring or an insert. The surface of the hydraulic actuator may comprise a raised portion of a shaft or a bore of the hydraulic actuator. The apparatus may further comprise means to cause the means to engage to disengage from the surface of the hydraulic actuator.

Although only a few example embodiments have been described in detail above, those skilled in the art will readily appreciate that many modifications are possible in the example embodiments without materially departing from this disclosure. Accordingly, all such modifications are intended to be included within the scope of this disclosure as defined in the following claims. In the claims, means-plus-function clauses are intended to cover the structures described herein as performing the recited function and not only as structural equivalents, but also equivalent structures. Thus, although a nail and a screw may be not structural equivalents in that a nail employs a cylindrical surface to secured wooden parts together, whereas a screw employs a helical surface, in the environment of fastening wooden parts, a nail and a screw may be equivalent structures. It is the express intent of the applicant not to invoke 35 U.S.C. §112, paragraph 6 for any limitations of any of the claims herein, except for those in which the claim expressly uses the words "means for" together with an associated function.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a first piston having a head portion and a stem portion, the stem portion having a bore therethrough;

a second piston disposed in the head portion of the first piston;

a shaft slidably disposed in the bore, the shaft including a plurality of raised surface portions;

a first ring disposed around the shaft;

a second ring disposed around the shaft; and a first spring positioned between the first and second rings to bias the first and second rings apart from one another;

wherein the first ring is configured to restrict movement of the shaft in at least one axial direction when the first ring is in a first position with respect to the second ring, and wherein the first ring does not restrict movement of the shaft when the first ring is in a second position with respect to the second ring.

2. The apparatus of claim 1 wherein the second ring prevents the first ring from moving radially-outward in the first position.

3. The apparatus of claim 1 further comprising a second spring abutting the second piston to bias the second piston towards an aperture in the head portion of the first piston.

4. The apparatus of claim 3, wherein movement of the second piston away from the aperture causes the second ring to move to the second position.

5. The apparatus of claim 1, wherein the first ring, the second ring or both comprise at least one finger extending radially-inward.

6. The apparatus of claim 1, wherein the first spring is compressed in the first position.

7. The apparatus of claim 1, wherein movement of the first piston is configured to extend a standoff of a downhole tool.

8. The apparatus of claim 7, wherein movement of the second piston is configured to release the standoff of the downhole tool.

* * * * *